US007465920B2

(12) United States Patent
Hiraoka

(10) Patent No.: US 7,465,920 B2
(45) Date of Patent: Dec. 16, 2008

(54) IONIZATION METHOD AND APPARATUS FOR MASS ANALYSIS

(75) Inventor: Kenzo Hiraoka, Yamanashi (JP)

(73) Assignee: University of Yamanashi, Yamanashi (JP)

( * ) Notice: Subject to any disclaimer, the term of this patent is extended or adjusted under 35 U.S.C. 154(b) by 257 days.

(21) Appl. No.: 10/594,837

(22) PCT Filed: Mar. 30, 2004

(86) PCT No.: PCT/JP2004/004520

§ 371 (c)(1),
(2), (4) Date: Sep. 28, 2006

(87) PCT Pub. No.: WO2005/104181

PCT Pub. Date: Nov. 3, 2005

(65) Prior Publication Data

US 2008/0054176 A1 Mar. 6, 2008

(51) Int. Cl.
*H01J 49/10* (2006.01)

(52) U.S. Cl. ..... 250/288; 250/281; 250/282; 250/423 R; 250/424; 250/425; 250/423 P

(58) Field of Classification Search ..... 250/281, 250/282, 288, 423 R, 424, 425, 423 P; 315/111.91; 96/16

See application file for complete search history.

(56) References Cited

U.S. PATENT DOCUMENTS 5,917,185 A * 6/1999 Yeung et al. ..... 250/288

FOREIGN PATENT DOCUMENTS

| | | |
|---|---|---|
| JP | 2-122259 | 5/1990 |
| JP | 2-176459 | 7/1990 |
| JP | 3-105841 | 5/1991 |
| JP | 3-503317 | 7/1991 |
| JP | 5-256837 | 8/1993 |
| JP | 6-508472 | 9/1994 |
| JP | 9-82269 | 3/1997 |
| JP | 9-304344 | 11/1997 |
| JP | 2000-500915 | 1/2000 |
| JP | 2004-184137 | 7/2004 |

OTHER PUBLICATIONS

"The Desorption Process in MALDI," Klaus Dreisewerd, Chem. Rev. 2003, 103, 395-425, 2003 American Chemical Society.

"A Comparative Study of Laser Spray and Electrospray," Ichiro Kudaka, Takanori Kojima, Shinpei Saito and Kenzo Hiraoka, Rapid Commun., Mass Spectrum 14, 1558-1562 (2000).

* cited by examiner

*Primary Examiner*—Jack I. Berman
*Assistant Examiner*—Michael Maskell
(74) *Attorney, Agent, or Firm*—Dickstein Shapiro LLP

(57) ABSTRACT

A laser spray method exhibiting a high detection sensitivity when applied to mass analysis has its sensitivity raised further. In a laser spray method of ionizing a liquid sample by irradiating, with a laser beam, the end of a capillary into which the sample has been introduced, use is made of an infrared laser as the laser beam, at least the end of the capillary is formed of a substance that does not readily absorb the laser beam used, and either the capillary is formed of a conductor and a high voltage is applied thereto, or the capillary is formed of an insulator, a conductive wire is placed inside a small cavity of the capillary and a high voltage is applied to the conductive wire.

20 Claims, 7 Drawing Sheets

IONIZATION METHOD AND APPARATUS FOR MASS ANALYSIS

TECHNICAL FIELD

This invention relates to an ionization method and apparatus for mass analysis. More particularly, the invention relates to a laser spray method and MALDI (Matrix-Assisted Laser Desorption Ionization).

BACKGROUND ART

The electrospray method, laser spray method and MALDI method, etc., are typical methods of ionizing a sample. The laser spray method is described in, e.g., I. Kudaka, T. Kojima, S. Saito and K. Hiraoka "A comparative study of laser spray and electrospray", Rapid Commun. Mass Spectrom. 14, 1558-1562 (2000). Further, the MALDI method is described in K. Dreisewerd "The Desorption Process in MALDI", Chem. Rev. 2003, 103, 395-425.

Among these ionization methods, the laser spray method, which ionizes a liquid sample by irradiating, with a laser beam, the end of a capillary into which a liquid sample has been introduced, is advantageous in that it has a detection sensitivity that is an order of magnitude higher than that of the electrospray method. Further, whereas the existing electrospray method is difficult to apply to a sample of an aqueous solution, the laser spray method has the advantage of being applicable to samples of aqueous solutions.

The MALDI method, on the other hand, irradiates a sample, which is mixed with and held by a matrix, with a laser beam to ionize the sample. In general, use is made of an ultraviolet nitrogen laser (wavelength: 337 nm). However, as the energy density of the laser beam is high, a problem which arises is that if the sample is a biological sample, the sample will be decomposed. In the mass analysis of DNA molecules and proteins, etc., it is desired that weakly bound samples having molecular weights that exceed several tens of thousands be ionized without being caused to decompose.

DISCLOSURE OF THE INVENTION

Accordingly, an object of the present invention is to further raise the sensitivity of the laser spray method, which has the advantages and merits mentioned above.

Further, the present invention provides an ionization method, which relies upon the highly sensitive laser spray method, in combination with an atmospheric-pressure ionization method.

A further object of the present invention is to provide a MALDI method that can be applied to the ionization of biological samples.

The present invention, which relates to the laser spray method, is such that in the laser spray method that ionizes a liquid sample by irradiating, with a laser beam, the end of a capillary (a slender tube provided with a slender cavity) into which the sample has been introduced, at least the end of the capillary is formed of a substance that does not readily absorb the laser beam used.

The liquid sample at the end of the capillary is vaporized by being irradiated with the laser beam, whereby positive or negative ions are produced. Since at least the end of the capillary is formed of the substance that does not readily absorb the laser light (which includes the meaning of not absorbing the laser light), almost all of the energy of the laser beam is introduced to raise the temperature of and vaporize the liquid sample at the end of the capillary. Though there is a possibility that droplets will be formed by the laser-beam irradiation, the droplets are trapped within the slender cavity in the end of the capillary and therefore the liquid sample is eventually vaporized almost completely. Thus, positive or negative ions are produced from the liquid sample efficiently.

There are several modes of laser-beam irradiation. One is to dispose the laser device in such a manner that the beam axis of the laser beam and the axial direction (longitudinal direction) of the capillary become substantially linearly configured so that the end of the capillary is irradiated with the laser beam substantially along the axis direction of the capillary. A second mode is to irradiate the end of the capillary with a laser beam from a direction substantially perpendicular to the axial direction of the capillary. Since the end of the capillary is formed of a substance that does not readily absorb the laser light used, the laser beam emitted passes through the end of the capillary and irradiates the liquid sample within. The end of the capillary may be irradiated with the laser beam from a direction that is inclined with respect to the axial direction of the capillary.

In a preferred embodiment, an infrared laser (e.g., wavelengths of 10.6 and 2.94 μm) is used as the laser. It is possible to acquire a continuously generated, high-power infrared laser device. Since a sample that includes water will absorb infrared light, the energy of the laser beam is used efficiently in the vaporization of the liquid samples.

Diamond, silicon and germanium, etc., are examples of materials that do not absorb, or do not readily absorb, infrared laser light. Though the capillary also can be formed by these materials, it is preferred that a tip having a small cavity and formed by these materials be attached to the end of an insulated capillary in such a manner that the small cavity in the tip will communicate with the slender cavity in the capillary. For example, a diamond tip provided with a small cavity for communicating with a slender cavity in an insulated capillary is attached to the end of the capillary.

In a preferred embodiment, at least the end of the capillary is placed in vacuum in the vicinity of an ion introduction port of a mass analyzer. As a result, positive or negative ions that have been generated in the proximity of the capillary end are sampled efficiently within the mass analyzer in vacuum. Of course, the end of the capillary may be placed under atmospheric pressure in the vicinity of the ion introduction port of the mass analyzer.

In order to greatly facilitate the ionization of a vaporized sample and prevent neutralization of the ionized sample, a strong electric field is formed at the end of the capillary. For example, an electric field is formed in the vicinity of the capillary end by forming the capillary of an electrical conductor and applying a positive or negative high voltage to the capillary.

According to another method, the capillary is formed of an insulator, a conductive wire (a metal wire, preferably a platinum wire) is placed inside the capillary and a positive or negative high voltage is applied to the conductive wire. As a result, the positive or negative ions in the liquid sample conveyed through the slender cavity in the capillary are concentrated. Preferably, the conductive wire is inserted into the capillary (into the slender cavity) and extends to a point near the end thereof.

Irradiation may be with a pulsed laser and it may also be so arranged that the liquid sample is passed through the capillary continuously and is irradiated with a laser beam that is generated continuously.

An ionization method according to the present invention, which is based upon the highly sensitive laser spray method in combination with an atmospheric-pressure ionization method, is such that in the laser spray method that ionizes a liquid sample by irradiating, with a laser beam, the end of a capillary into which the sample has been introduced, at least the end of the capillary is formed of a substance that does not readily absorb the laser light used, at least the end of the capillary is placed in a corona-discharge gas (inclusive of the atmosphere), a corona-discharge electrode is provided in the vicinity of the end of the capillary and a positive or negative high voltage is applied to the corona-discharge electrode to thereby induce a corona discharge.

As mentioned above, the liquid sample at the end of the capillary is vaporized by irradiation with a laser beam and positive or negative ions are generated. At this time, molecules that have remained neutral, or neutral molecules that have become neutralized by recombination of positive or negative ions, also exist. These neutral molecules are protonated or deprotonated by the corona discharge, whereby positive or negative ions are produced. Thus, since ionization takes place in a concentrated state near the end of the capillary, the efficiency with which neutral molecules are ionized can be improved.

A corona-discharge electrode can be provided utilizing a conductive wire that has been inserted into the above-described capillary. That is, the capillary is formed of an insulator, a conductive wire is disposed inside the capillary and the end of the conductive wire is caused to project slightly beyond the end of the capillary to thereby serve as a corona-discharge electrode.

By placing at least the end of the capillary in the atmosphere, the combination with the atmospheric-pressure ionization method is achieved. In this case, it is particularly preferred that an assist gas be supplied to the vicinity of the capillary end. As a result, the corona discharge can be produced with facility and the discharge plasma can be sustained stably.

An arrangement in which the assist gas is supplied utilizing the capillary can be adopted. Specifically, an outer tube is provided on the outer side of the capillary with a clearance being left between itself and the outer peripheral surface of the capillary, and the assist gas is introduced to the vicinity of the capillary end through the space between the outer peripheral surface of the capillary and the outer tube.

The laser driving method and the method of laser irradiation can employ all of the modes described above. That is, the liquid sample is irradiated with pulsed laser light or the liquid sample is passed through the capillary continuously and is irradiated with a laser beam that is generated continuously. The end of the capillary is irradiated with the laser beam directed substantially along the axial direction of the capillary, or the end of the capillary is irradiated with the laser beam from a direction substantially perpendicular to or inclined with respect to the axial direction of the capillary.

An ionization apparatus according to the present invention is characterized in that in a laser-spray apparatus for ionizing a liquid sample by irradiating, with a laser beam, the end of a capillary into which the sample is introduced, at least the end of the capillary is formed of a substance that does not readily absorb the laser beam used.

More specifically, an ionization apparatus according to the present invention in such that an ionization space that communicates with a mass analyzer through an ion introduction port is formed by a housing on the outer side of the ion introduction port of the mass analyzer, at least the end of the capillary for introducing a liquid sample is placed inside the ionization space, a laser device for irradiating the end of the capillary with a laser beam is placed outside the ionization space, and at least the end of the capillary is formed of a substance that does not readily absorb the laser light used.

The ionization space may be made a vacuum or a corona-discharge gas may be introduced into the space (or the space may be opened to the atmosphere).

In one embodiment, the capillary is formed of an insulating material, a diamond tip provided with a slender cavity that communicates with a slender cavity in the capillary is attached to the end of the capillary, and a conductive wire to which a high voltage is applied is placed inside the slender cavity of the capillary.

In this case, an end of the conductive wire is inside the capillary and extends to a point near the end of the capillary.

In apparatus for implementing a method of ionizing neutral molecules by a corona discharge, a corona-discharge electrode is provided in the vicinity of the end of the capillary. Alternatively, the end of the conductive wire that has been inserted into the capillary is caused to project outside slightly beyond the diamond tip at the end of the capillary.

A method of driving a laser device and the placement of the laser device (the irradiating direction of the laser beam) can employ all of the modes described above.

The present invention, which relates to the MALDI method, is such that in the MALDI method for ionizing a sample by irradiating the sample, which is mixed with and held by a matrix, with a laser beam, the method includes using a low-molecular-weight inorganic matrix that includes water, holding the sample, which has been mixed with the inorganic matrix, in a depression of a substrate formed to have a protrusion at least at a portion of the periphery of the depression, and irradiating the sample with an infrared laser beam. Irradiation with a pulsed laser beam is preferred.

In accordance with the present invention, infrared laser light is used. Because a low-molecular-weight inorganic matrix that includes water absorbs infrared light, a sample can be heated (evaporated) instantaneously at high speed. Since a biological sample that includes water also absorbs infrared light, the method according to the present invention is ideal for ionization of biological samples. An inorganic material is used as the matrix. Even when these are thermally decomposed, therefore, noise in mass analysis will not readily occur and detection sensitivity can be improved. Furthermore, since the sample mixed with the inorganic matrix is held in the depression of the substrate, the sample is confined in the depression, so to speak, and almost all of the energy of the infrared laser light is expended to heat and vaporize the sample and the inorganic matrix.

In order to facilitate the ionization of a vaporized sample and prevent neutralization, an electric field is formed surrounding the sample held in the depression of the substrate. For example, the electric field is formed by applying a high voltage to an electrically conductive substrate. Since the periphery of the depression is formed to have a protrusion, an electric field having a high electric field strength is formed.

Porous silicon can be used as the substrate. Since the surface of porous silicon has innumerable holes of nano-order size, the holes can be utilized as the depressions and the substrate need not be subjected to micromachining. Further, since the periphery of each hole has a sharp protrusion, the electric field strength is raised.

It is preferred that the substrate be cooled in order to hold a biological sample, which is based upon an inorganic matrix that includes water, on the substrate. This makes it possible to prevent drying of the sample.

An ionization apparatus according to the present invention is such that an ionization space held in vacuum and communicating with a mass analyzer through an ion introduction port is formed by a housing on the outer side of the ion introduction port of the mass analyzer, a substrate having a depression at least a portion of the periphery of which is formed to have a protrusion is placed inside the ionization space, and a laser device for irradiating a sample, which has been mixed with an inorganic matrix held in the depression of the substrate, with an infrared laser beam is placed outside the ionization space.

In one embodiment, a cooling device for cooling the substrate is provided.

BEST MODE FOR CARRYING OUT THE INVENTION

First Embodiment

Figure 1:
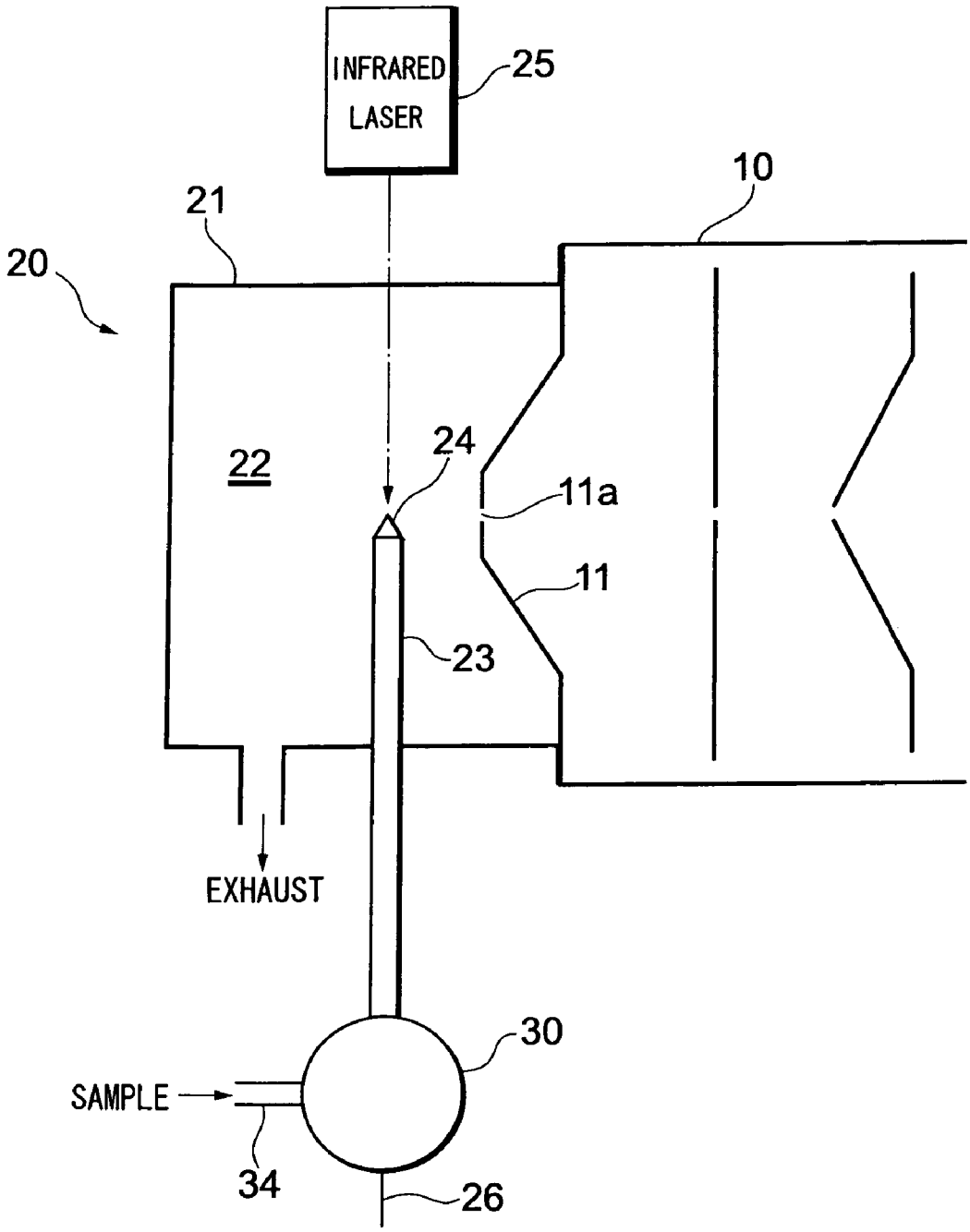
FIG. 1 is a structural view illustrating an ionization apparatus according to a first embodiment.

FIG. 1 illustrates the overall structure of an ionization apparatus of a first embodiment attached to a mass analyzer in the vicinity of an ion introduction port.

An orifice 11 provided with a miniscule hole 11*a* is attached to a mass analyzer 10 at the ion introduction port thereof. The miniscule hole 11*a* serves as the ion introduction port. The interior of the mass analyzer 10 is held in vacuum.

A housing 21 of an ionization apparatus 20 is attached hermetically to the vessel wall of the mass analyzer 10 so as to surround and cover the orifice 11. The space delimited by the housing 21 and orifice 11 is an ionization space 22. The interior of the ionization space 22 is held in vacuum (e.g., $10^{-3}$ Torr) by an exhaust device (pump) (not shown).

A capillary (made of silica or alumina) 23 for supplying a liquid sample is provided penetrating the wall of the housing 21. The distal end of the capillary 23 is inside the ionization space 22 (housing 21), and the base end thereof projects outwardly of the housing and is connected to a coupling body 30. Though the details will be described later, a diamond tip 24 is attached to the end of the capillary 23. An infrared laser device 25 is disposed outside the housing 21. An infrared laser beam having a wavelength of 10.6 μm is emitted by the laser device 25 and impinges internally of the housing 21 through a transparent wall portion of the housing 21 or window formed by a transparent body. The laser device 25 is disposed in such a manner that the emitted laser beam will be projected upon the diamond tip 24 at the end of the capillary 23 along the axial direction of the capillary 23.

Figure 4:
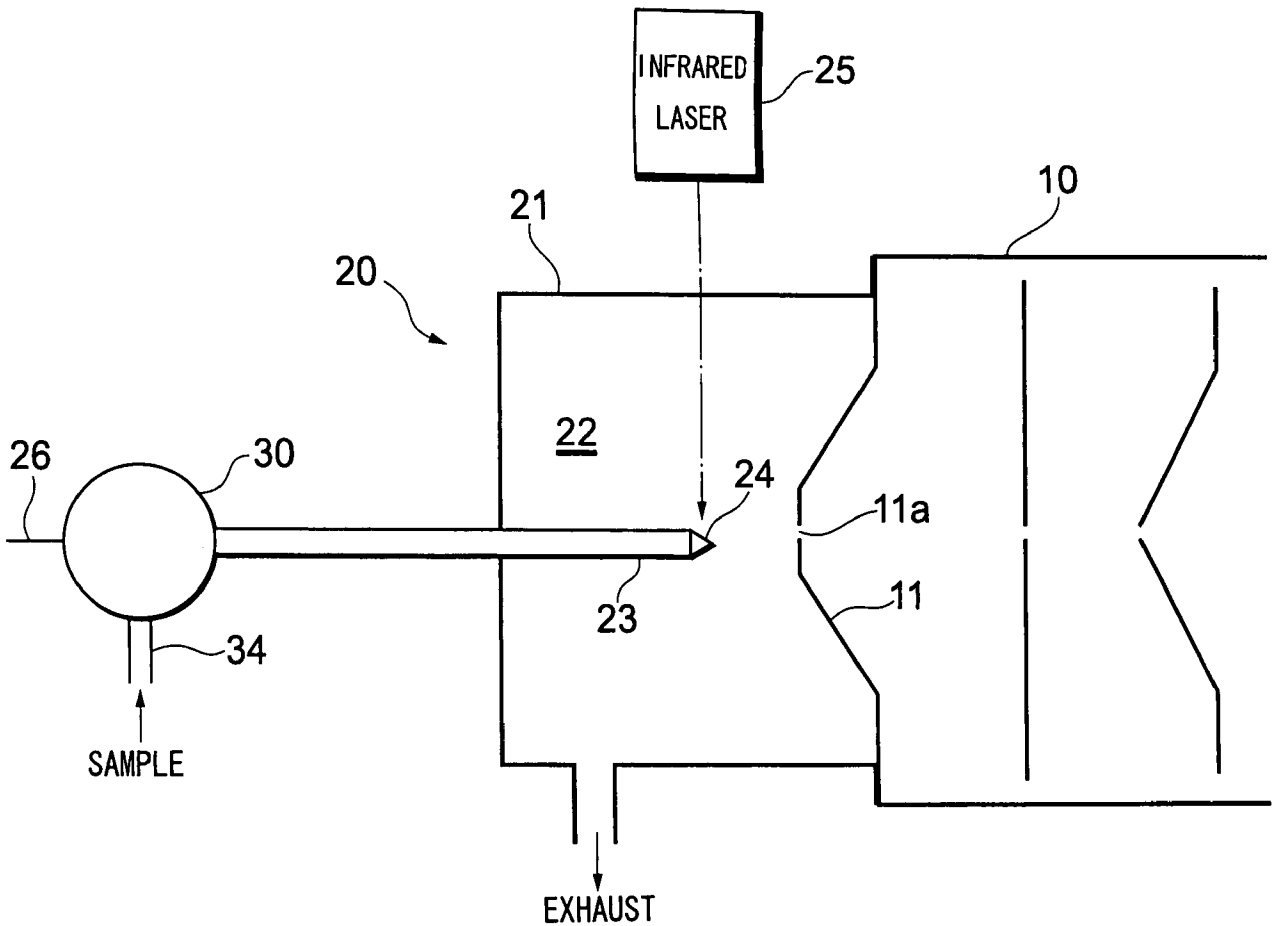
FIG. 4 is a structural view corresponding to FIG. 1 and illustrating another example of placement of a laser device.

As illustrated in FIG. 4, it is also permissible to adopt an arrangement in which the laser device 25 is placed at the side of the capillary 23 and the emitted laser beam is projected upon the diamond tip 24 from a direction perpendicular to the axial direction of the capillary 23. Since the diamond tip 24 allows the infrared laser beam to pass through, the infrared laser beam irradiates the liquid sample within the diamond tip 24. It may also be arranged so that the laser beam is projected from a direction inclined with respect to the axial direction of the capillary 23.

Figure 2:
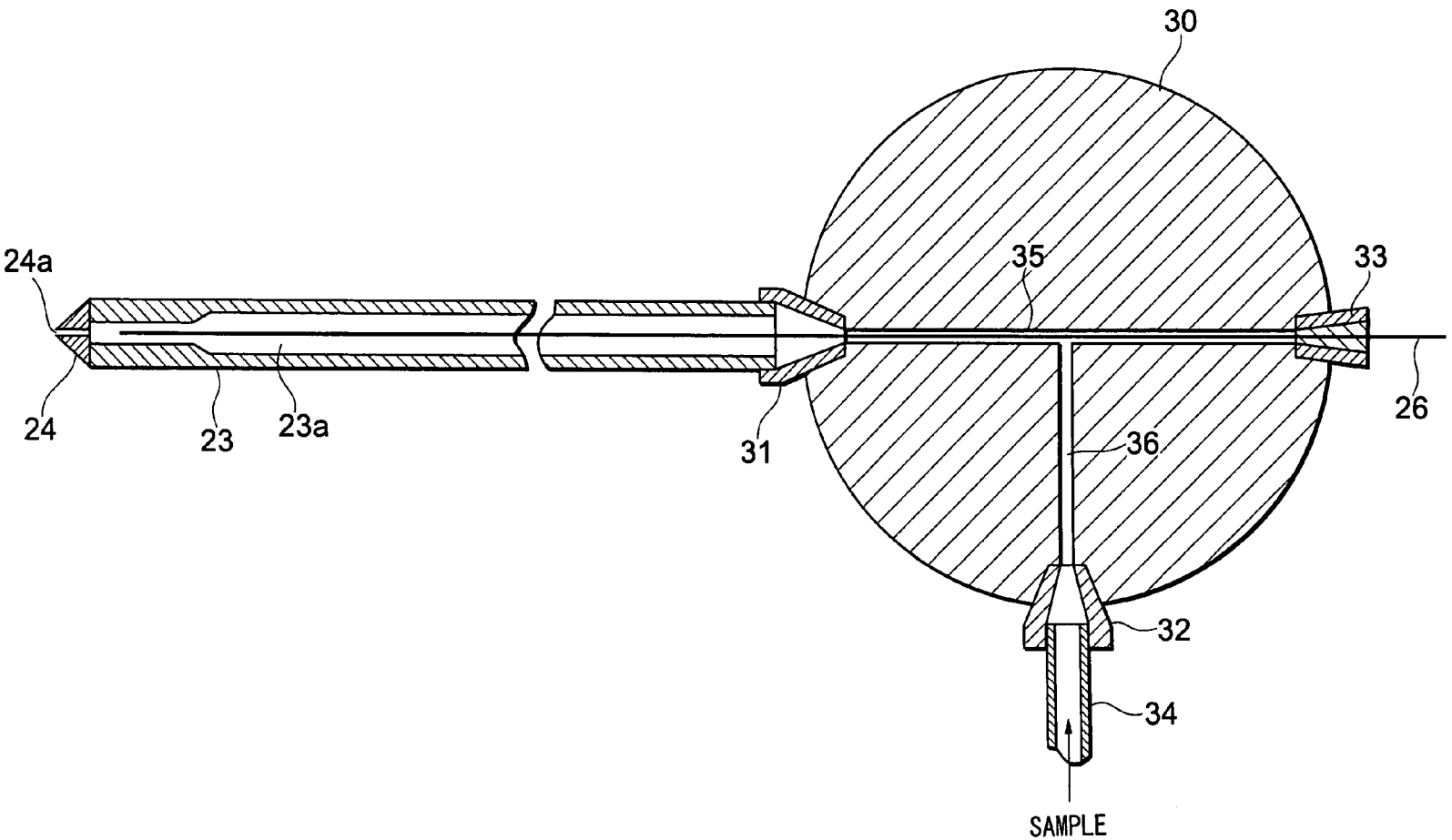
FIG. 2 is a sectional view illustrating a capillary and a diamond tip at the end thereof.

FIG. 2 illustrates the arrangement of the capillary 23, the diamond tip 24 attached to the end of the capillary, and the coupling body 30.

The capillary 23, which is a slender tube formed by an electrical insulator such as plastic or silica (glass), is internally provided with a slender cavity 23*a* extending in the lengthwise direction.

The diamond tip 24 attached to the end of the capillary 23 is conical in shape and is formed to have a small cavity 24*a* at its center. The diamond tip 24 is bonded and affixed to the end face of the end of the capillary 23 in such a manner that the small cavity 24*a* of the diamond tip 24 and the slender cavity 23*a* of the capillary 23 will communicate along a straight line. The capillary 23 is disposed in such a manner that the diamond tip 24 will be situated in the vicinity of the hole 11*a* in the orifice 11 of the mass analyzer 10.

The coupling body 30 is formed to have passageways 35, 36 in a T-shaped configuration. The passageway 35 passes through the center of the coupling body 30 and is open at both ends. The passageway 36 is formed to be perpendicular to the passageway 35 and the two passageways communicate with each other.

The base end of the capillary 23 is connected to the coupling body 30 to one end of the passageway 35 via a plug 31 so that the slender cavity 23*a* is communicated with the passageway 35. A plug 33 for maintaining watertightness is provided in the other end of the passageway 35. A conductive wire (e.g., a platinum wire, which is strongly resistant to corrosion) 26 is inserted into the passageway 35 through the plug 33 from outside the plug 33 and reaches the vicinity of the end of the capillary 23 (namely a point 5 to 10 mm short of the diamond tip 24) through the slender cavity 23*a*. A sample introduction tube 34 is connected to the outer end of the passageway 36 via the plug 32. The liquid sample is supplied from the introduction tube 34 to the capillary 23 through the passageways 36, 35.

Figure 3:
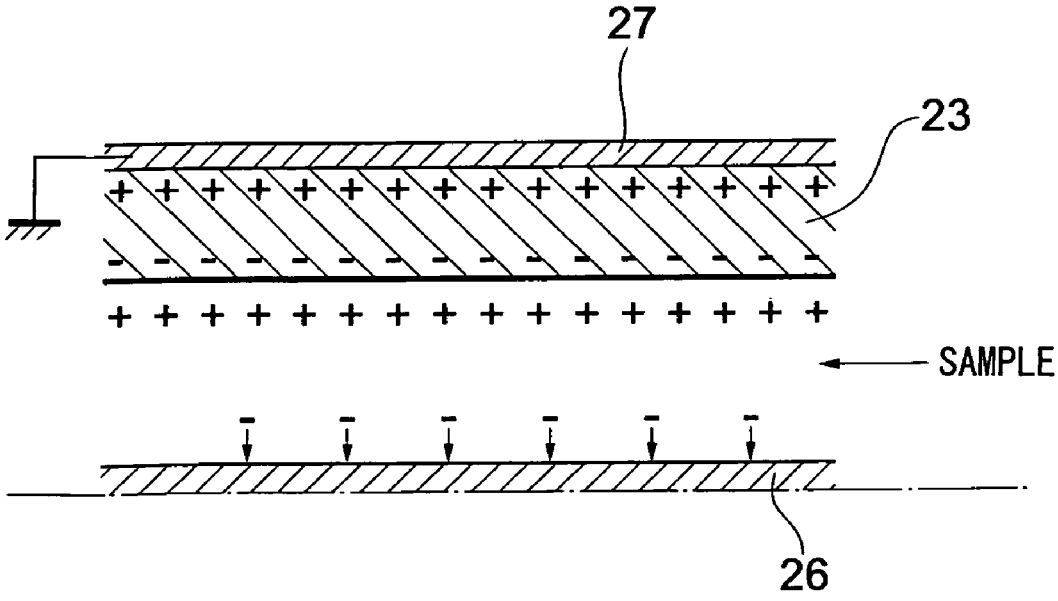
FIG. 3 illustrates the interior of the capillary in enlarged form.

A positive (or negative) high voltage is applied to the conductive wire 26. As a result, as shown in FIG. 3, the liquid sample inside the capillary 23 is ionized. The negative ions flow into the conductive wire 26 and therefore excessive positive ions are produced. The ionized sample also fills the interior of the small cavity 24*a* in the diamond tip 24. The outer peripheral surface of the capillary 23 is formed to have an external electrode 27, which is grounded.

Under these conditions, the liquid sample inside the small cavity 24*a* of the diamond tip 24 is irradiated with the pulsed infrared laser beam from the laser device 25. The sample is instantaneously heated and vaporized by the laser beam. Since at least the water content of the liquid sample absorbs the infrared laser beam, the heating by the laser beam is performed effectively. Further, since diamond does not absorb infrared light, vaporization is achieved in a state in which the sample is confined, so to speak, in the small cavity 24*a*.

Positive (or negative) ion molecules or ion atoms thus vaporized are attracted to the negative voltage applied to the orifice 11 and are introduced into the mass analyzer 10 from the hole 11*a*.

In a case where the mass analyzer has been connected for chromatography or the like, it will suffice for the liquid sample to be supplied continuously to the diamond tip 24 and for the sample to be irradiated with the infrared laser beam, which is generated continuously.

Silicon and germanium, etc., can be used instead of diamond as materials that do not readily absorb infrared light. The capillary itself may be formed by silicon or germanium.

In a case where the capillary has been formed by an electrical conductor such as metal, the conductive wire 26 will be unnecessary and it will suffice if the positive or negative high voltage is applied to the conductive capillary per se.

Second Embodiment

Figure 5:
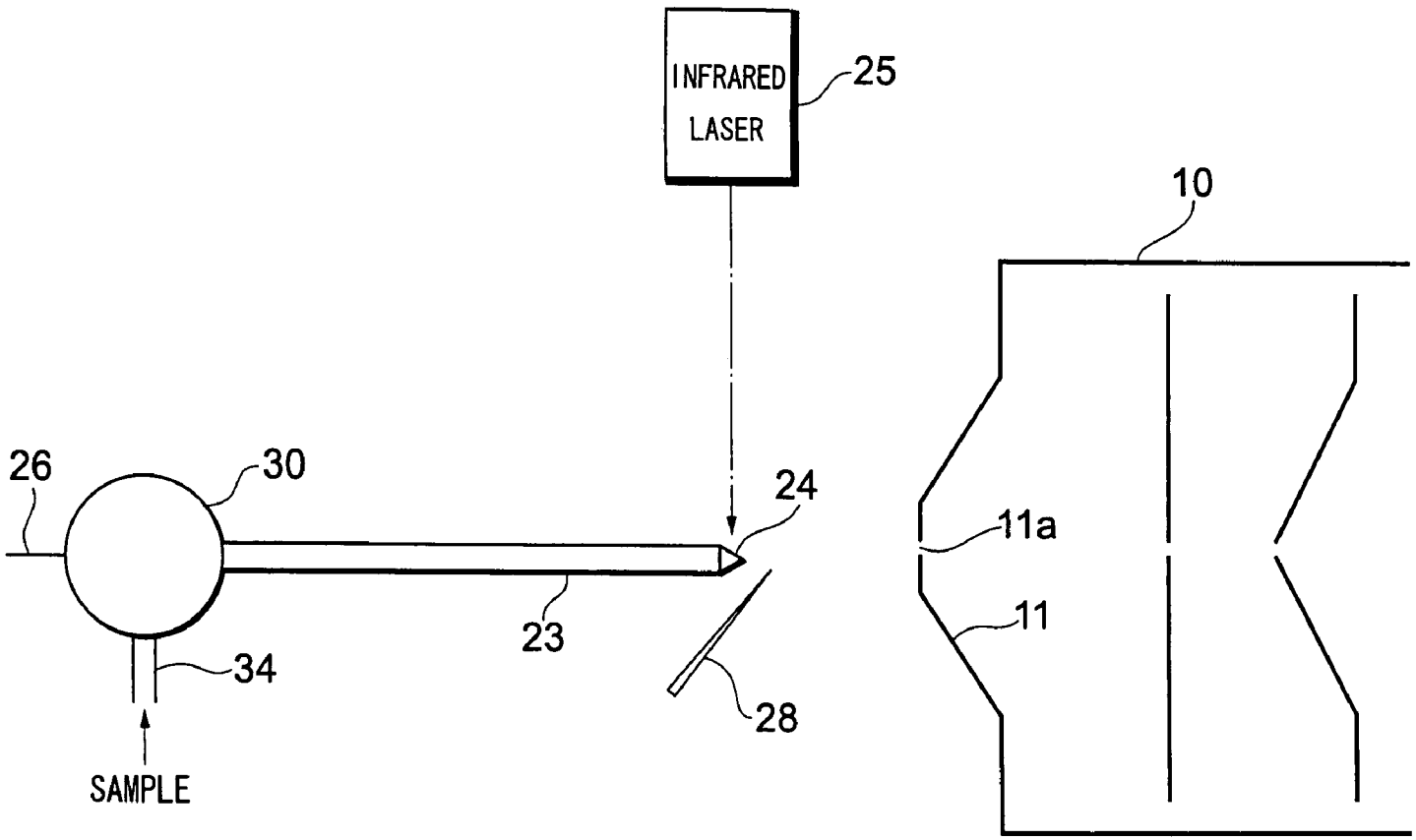
FIG. 5 is a structural view illustrating an ionization apparatus according to a second embodiment.

FIG. 5 shows the atmospheric-pressure ionization method combined with an ionization method based upon the above-described laser spray method. In FIG. 5, the housing 21 is not illustrated. However, the housing itself may be deleted (the capillary 23, the diamond tip 24 and a corona-discharge electrode 28 are placed under atmospheric pressure), the housing 21 may be provided and the interior thereof brought to atmospheric pressure, or a corona-discharge gas (inclusive of the atmosphere) may be introduced into the housing 21.

As mentioned above, the capillary 23 is disposed in such a manner that the diamond tip 24 is situated in close proximity to the outer side of the hole 11*a* in the orifice 11 of mass analyzer 10. A conductive wire may or may not be inserted into the capillary 23. In this embodiment, the corona-discharge electrode 28 is provided in the vicinity of the end of the capillary 23.

As mentioned above, the diamond tip 24 is irradiated with an infrared laser beam of narrowed focal point and a sample in an aqueous solution inside the small cavity 24*a* of the diamond tip 24 is vaporized completely. Though there are cases where ions that existed in the liquid are vaporized as is as ions, molecules that have remained neutral, or neutral molecules that have become neutralized by recombination of positive and negative ions, also are generated.

The sample gas that has been completely vaporized is jetted from the end of the diamond tip 24 owing to irradiation with the infrared laser beam. The corona-discharge electrode 28 is disposed very close to the end of the diamond tip 24 from which the gas is jetted. A corona discharge is induced by applying a positive or negative high voltage upon the corona-discharge electrode 28. When the corona discharge is caused by the application of a positive high voltage, a protonated neutral sample $[M+H]^+$ is mainly produced. In a case where a negative high voltage is applied, negative ions $[M-H]^-$ obtained by deprotonating neutral sample molecules are mainly produced. Since ionization is performed in a state in which the sample molecules have been concentrated near the end of the diamond tip 24 by the corona discharge, the neutral-molecule ionization efficiency can be improved. Accordingly, neutral-molecule detection efficiency that is obtained is an order-of-magnitude higher than that of the conventional atmospheric-pressure ionization method (a method in which a sample gas is ionized in a state in which the sample molecules have been dispersed over the entirety of the ionization chamber).

Conventionally, the analysis of neutral molecules in a liquid sample entails first converting the liquid sample into droplets by ultrasound or by a nebulizer and subsequently heating the vessel wall to vaporize the liquid sample and achieve atmospheric-pressure ionization. In accordance with the method of this embodiment, it is unnecessary to promote vaporization of the liquid sample by raising the temperature of the vessel wall of the ionization chamber. As a result, soft ionization can be performed without an easily thermally decomposable biological sample being caused to decompose. With infrared-laser irradiation of the diamond tip 24, the diamond tip 24 is not heated. In addition, the energy of the laser beam is expended in severing the hydrogen bonds of the solvent and does not lead to vibrational excitation of the molecules. Accordingly, an advantage obtained is that decomposition of the sample molecules can be almost completely ignored.

The ions that have been generated under atmospheric pressure pass through the hole 11*a* in the orifice 11 and are sampled and undergo mass analysis in vacuum. Examples of the mass analyzer 10 that can be used are an orthogonal time-of-flight mass spectrometer, a quadrupole mass spectrometer and magnetic-field mass spectrometer.

Figure 6A:
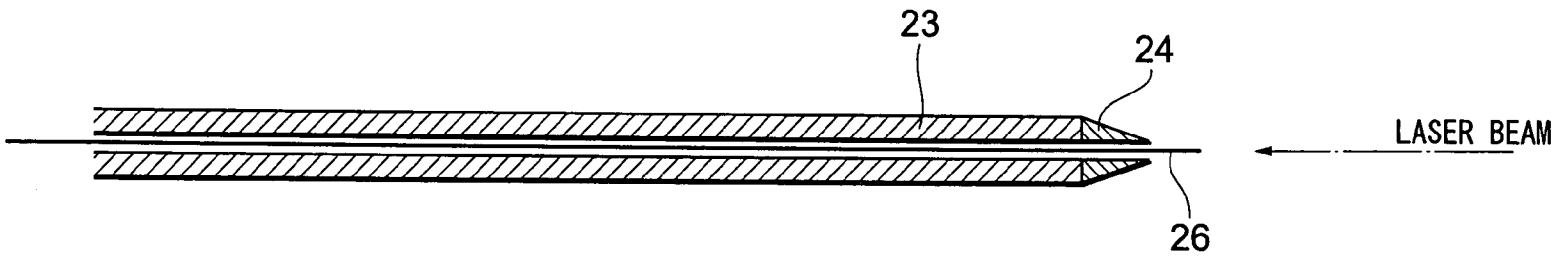
FIGS. 6*a* and 6*b* are sectional views illustrating other examples of the structure of a capillary.

FIG. 6*a* illustrates another example of a corona-discharge electrode. The end of the conductive wire (a metal wire or platinum wire) 26 that has been inserted into the capillary 23 is caused to project outside slightly (several millimeters) beyond the end of the diamond tip 2, and the end of the conductive wire 26 is made to serve as a corona-discharge electrode. The end of the conductive wire 26 may be ground to a sharp point in order to facilitate the generation of discharge plasma.

As set forth above, a sample of an aqueous solution is passed through the capillary 23 and the liquid sample that flows out of the diamond tip 24 is irradiated with the laser beam (infrared laser: 10.6 μm) to thereby completely vaporize the sample. Under these conditions, a high voltage (several hundred to several kV) is impressed upon the conductive wire 26 that has been passed through the center of the capillary 23, thereby inducing a corona discharge at the end of the conductive wire 26. Ions are generated in the plasma by this corona discharge. For example, with a sample of an aqueous solution, the solvent is water and therefore a large quantity of hydrated clusters of protons is generated by electrical discharge of water vapor.

Generation of $H^+(H_2O)_n$ cluster ions in water-vapor plasma $$H_2O+e\ (\text{electron}) \rightarrow H_2O^+ + 2e \quad (1):$$

electron ionization (induced in plasma)

$$H_2O^+ + H_2O \rightarrow H_3O^+ + OH \quad (2):$$

proton migration reaction $$H_3O^+ + nH_2O \rightarrow H_3O^+(H_2O)_n \quad (3):$$

cluster ring reaction

The $H_3O^+$and hydrated cluster ions $H_3O^+(H_2O)_n$ cause a proton migration reaction with an analyte component B in the sample, thereby generating $H^+B$.

$$H^+(H_2O)_n + B \rightarrow H^+B + nH_2O \quad (4)$$

Since this reaction occurs in atmospheric pressure, it causes a very large number of collisions between the $H^+(H_2O)_n$ ions and ambient gaseous molecules. Consequently, even if the concentration of the analyte component B is very low, the component B can be detected with satisfactory sensitivity because the reaction (4) takes place in an efficient manner.

As set forth above, the method of this embodiment is a combination of the atmospheric-pressure ionization method and complete vaporization (by the laser spray method) of a liquid sample by irradiation with a laser. In the case of a biological sample, it is preferred that the solvent be water. In the case of a sample in an aqueous solution, water vapor is produced by irradiation with a laser beam. A property of water vapor is that it does not lend itself to generation of a discharge plasma. This problem is mitigated greatly by mixing in a rare gas (argon gas, etc.) as an ambient gas.

Figure 6B:
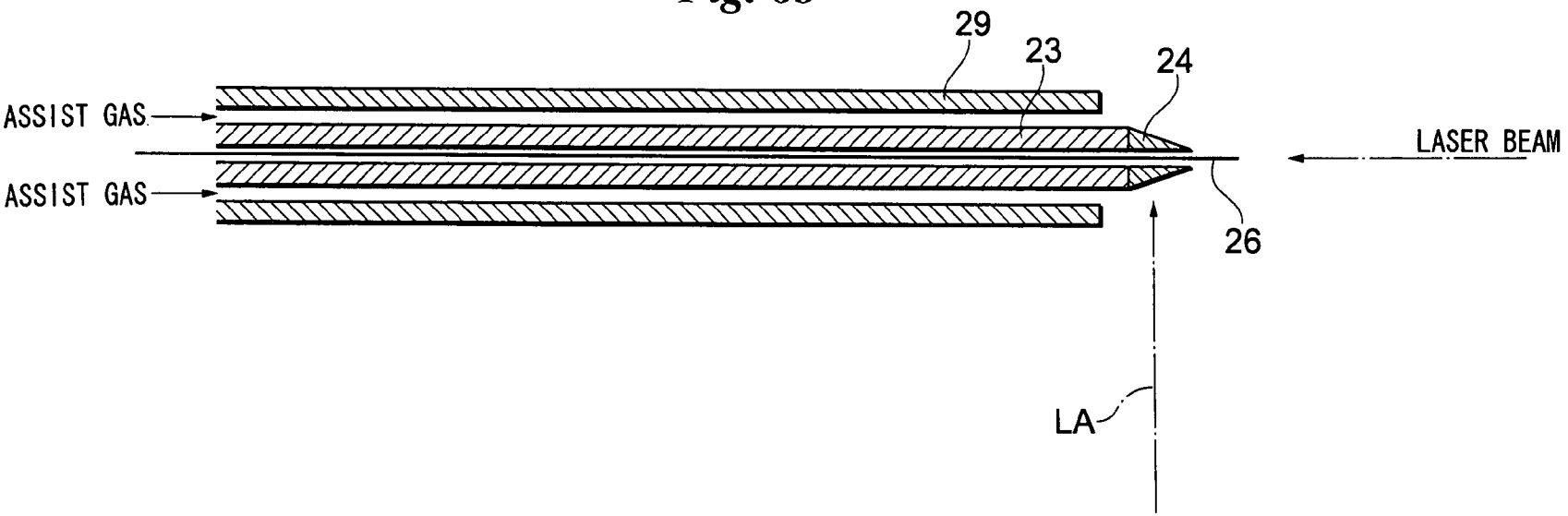

As shown in FIG. 6*b*, an outer tube 29 is provided on the outer side of the capillary 23, from which the liquid sample flows, with a gap (clearance) being left between itself and the outer peripheral surface of the capillary 23, and an assist gas such as argon gas is supplied to the vicinity of the end of the capillary 23 (diamond tip 24) through the gap between the outer peripheral surface of the capillary 23 and the outer tube 29. By mixing the solvent vapor of the instantaneously vaporized and the argon gas, the corona discharge is produced with ease and the discharge plasma can be sustained stably.

This method is such that if the molecules are molecules having a proton affinity greater than that of water molecules, all of these can be detected with high sensitivity. Since there are usually many biological molecules having a proton affinity greater than that of water molecules, this method is very effective in analyzing biological samples. Further, by combining this method with liquid chromatography (LC) (where a liquid sample that is output from LC is supplied to the capillary 23), the mixture components are isolated beforehand and it is possible to detect each component separately. With an ordinary LC detector (ultraviolet absorbing detector, etc.), identification of the molecules is difficult. By comparison, the mass analysis method using the above-described ionization method is such that the molecule B undergoes mass analysis as BH+, and therefore the molecular weight of the analyte component is obtained. Further, ions are extracted from the atmospheric-pressure ion source to the side of vacuum and cause collision-induced dissociation, thereby making it possible to obtain molecular structure information as well.

The above-described ionization method vaporizes an aqueous sample momentarily by irradiation with an infrared laser beam and causes the gaseous sample to converge to the center of the diamond tip (i.e., concentrates the sample without allowing it to diverge), in which state the corona discharge is produced at the center. As a result, first reaction ions $H_3O^+(H_2O)_n$ (in a case where the solvent is water) are produced. These reaction ions $H_3O^+(H_2O)_n$ repeatedly collide a large number of times with the ambient gaseous molecules under atmospheric pressure. If there is even a single collision with a molecule of the analyte component, the proton migration reaction (4) will always take place. After collisions a large number of times, therefore, the major part of the protons ($H^+$) of the reaction ions $H_3O^+(H_2O)_n$ eventually shift to the molecules B of the analyte component, the molecules B are ionized (protonated) and electric charge migrates to the molecules B (protonated B molecules, i.e., $H^+B$, are generated). This process can be regarded as a process that utilizes an ion molecule reaction (proton migration reaction) to concentrate the molecules B in the form of ions ($H^+B$). With this ionization method, analysis on the ppb level can be performed with ease. (It is possible to ionize $1/10^9$ components, which corresponds to a concentration efficiency of $10^9$. The reaction ions undergo collisions with ambient molecules at least $10^9$ times.)

In a case where a plurality of types of molecules having different proton affinities are mixed with the sample, ion—molecule reactions (proton migration reactions) take place sequentially and there may be instances where it is difficult to perform identification and analysis of each component. However, by combining this method with LC, the components are isolated beforehand by liquid chromatography and then the components flow out to the diamond tip. Even though the sample is a mixed sample, therefore, the possibility that a plurality of types of samples will be mixed together at the end of the diamond tip need not be taken into account.

In FIG. 5, the laser beam is projected toward the diamond tip 24 perpendicularly with respect to the axial direction of the capillary 23. In FIGS. 6*a* and 6*b*, the laser beam is projected into the diamond tip 24 along the axial direction of the capillary 23. The direction along which the laser beam is projected may be either of the above. The laser beam may be projected perpendicular to the axial direction of the capillary 23, as indicated at LA in FIG. 6*b*.

Third Embodiment

Figure 7:
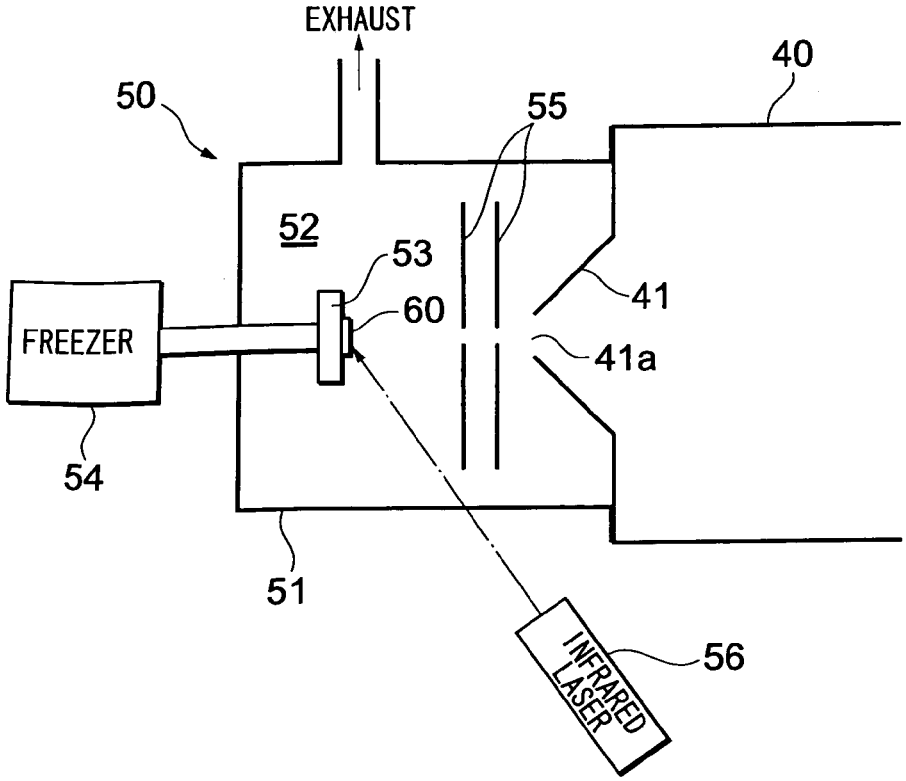
FIG. 7 is a structural view illustrating an ionization apparatus according to a third embodiment.

FIG. 7 illustrates the overall structure of an ionization apparatus according to a third embodiment attached to a mass analyzer in the vicinity of an ion introduction port.

A skimmer 41 provided with a somewhat large aperture 41*a* is attached to a mass analyzer 40 at the portion thereof having an ion introduction port. The aperture 41*a* serves as the ion introduction port. The interior of the mass analyzer 40 is held in vacuum.

A housing 51 of an ionization apparatus 50 is attached hermetically to the vessel wall of the mass analyzer 40 so as to surround and cover the skimmer 41. The space delimited by the housing 51 and skimmer 41 is an ionization space 52. The interior of the ionization space 52 is held in a high vacuum (e.g., $10^{-6}$ to $10^{-7}$ Torr) by an exhaust device (pump) (not shown).

A sample table 53 is provided in the ionization space 52 inside the housing 51 and is supported by the arm of a cryogenic freezer 54 placed outside the housing 51. The cryogenic freezer 54 has the capability to effect cooling to, e.g., 10 K. Further, grids 55 that guide ions to the aperture 41*a* of the skimmer 41 are provided inside the housing 51.

Figure 8:
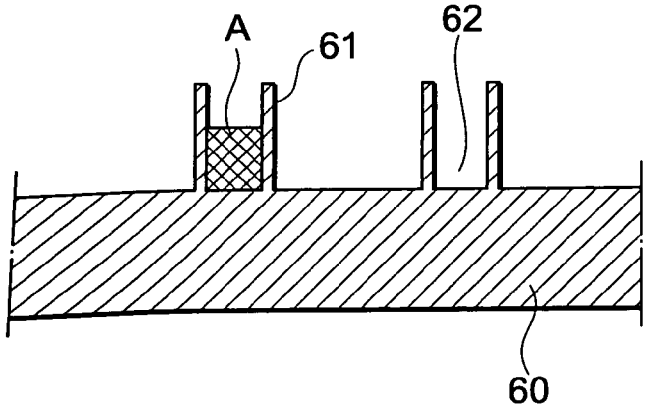
FIG. 8 is a sectional view illustrating part of a substrate in enlarged form.

As shown in FIG. 8, a substrate 60 comprises a silicon substrate which, by being subjected to micromachining, is formed to have a number of sample-holding depressions 62 on its surface. Each depression 62 is surrounded by a cylindrical protrusion (wall) 61 formed as an integral part of the substrate 60. A sample to be ionized is accommodated within and held by the depression 62.

The sample is, e.g., a biological sample (DNA, protein molecules, etc.) and has been mixed with an inorganic matrix such as water or $SF_6$ having a low molecular weight.

The substrate is not limited to the shape shown in FIG. 8, and porous silicon, for example, may serve as the substrate. Porous silicon has innumerable nano-size holes the peripheries of which are formed to have sharp protrusions. The porous silicon surface is coated with a sample of an aqueous solution. This is frozen and then subsequently subjected to laser irradiation. A thin film of water and $SF_6$ may be vacuum-deposited on the top layer of the applied sample and then subjected to laser irradiation (this state also is assumed to be covered by the expression "the sample has been mixed with a matrix").

Thus, the substrate 60 holding the sample that has been mixed with a matrix is attached to the sample table 53 inside the ionization space 52. A positive or negative high voltage is applied to the substrate 60. The sample on the substrate inside housing 51 is irradiated obliquely with an infrared laser beam from an infrared-laser source 56 disposed outside the housing 51. The low-molecular-weight inorganic matrix that includes water absorbs the infrared light in a highly efficient manner and causes a shock wave to be generated in the vicinity of the surface thereof. The shock wave generated is directed toward the substrate 60. Through this process, the matrix and sample are heated rapidly, the sample is desorbed and gaseous-phase positive or negative ions are generated efficiently owing to the high-strength electric field impressed upon the protrusions 61 or the protrusions of porous silicon. These ions head in a direction perpendicular to the surface of the substrate 60 and are guided into the time-of-flight mass analyzer 40 from the aperture 41*a* of the skimmer 41.

Since the matrix comprises an inorganic material of low molecular weight, the material will not constitute a large noise component even if it is ionized and introduced into the mass analyzer 40.

Since a matrix that includes water absorbs infrared light, the sample is heated rapidly. Because a biological sample also includes a water component and absorbs infrared light, it is heated efficiently.

Since the sample is frozen in the above embodiment, it can be prevented from drying.

The invention claimed is:

1. In a laser spray method for ionizing a liquid sample by irradiating, with a laser beam, the end of a capillary into which the sample has been introduced, an ionization method characterized by using an infrared beam as the laser beam, and forming at least the end of the capillary of any of diamond, silicon or germanium which is a substance that does not readily absorb the infrared laser beam used.

2. An ionization method according to claim 1, wherein a diamond tip provided with a small cavity for communicating with a slender cavity in an insulated capillary is attached to the end of the capillary.

3. An ionization method according to claim 1, wherein at least the end of the capillary is placed in vacuum in the vicinity of an ion introduction port of a mass analyzer.

4. An ionization method according to claim 1, wherein at least the end of the capillary is placed under atmospheric pressure in the vicinity of an ion introduction port of a mass analyzer.

5. An ionization method according to claim 1, wherein an electric field is formed in the vicinity of the end of the capillary by forming the capillary of an electrical conductor and applying a high voltage to the capillary.

6. An ionization method according to claim 1, wherein the capillary is formed of an insulator, a conductive wire is placed inside the capillary and a high voltage is applied to the conductive wire.

7. An ionization method according to claim 1, wherein at least the end of the capillary is placed in a corona-discharge gas, a corona-discharge electrode is provided in the vicinity of the end of the capillary and a positive or negative high voltage is applied to the corona-discharge electrode to thereby induce a corona discharge.

8. An ionization method according to claim 7, wherein the capillary is formed of an insulator, a conductive wire is placed inside the capillary and the end of the conductive wire is caused to project slightly beyond the end of the capillary to thereby serve as a corona-discharge electrode.

9. An ionization method according to claim 7, wherein the end of the capillary is placed in atmospheric pressure.

10. An ionization method according to claim 7, wherein an assist gas be supplied to the vicinity of the end of the capillary.

11. An ionization method according to claim 10, wherein an outer tube is provided on the outer side of the capillary with a clearance being left between itself and the outer peripheral surface of the capillary, and the assist gas is introduced to the vicinity of the end of the capillary through a space between the outer peripheral surface of the capillary and the outer tube.

12. An ionization method according to claim 1, wherein irradiation is with a pulsed laser beam.

13. An ionization method according to claim 1, wherein the liquid sample is passed through the capillary continuously and is irradiated with a laser beam that is generated continuously.

14. An ionization method according to claim 1, wherein the end of the capillary is irradiated with the laser beam directed substantially along the axial direction of the capillary.

15. An ionization method according to claim 1, wherein the end of the capillary is irradiated with the laser beam from a direction substantially perpendicular to the axial direction of the capillary.

16. In a laser spray apparatus for ionizing a liquid sample by irradiating, with a laser beam, the end of a capillary into which the sample has been introduced, an ionization apparatus characterized in that the capillary is formed of an insulating material, a diamond tip provided with a slender cavity that communicates with a slender cavity in the capillary is attached to the end of the capillary, and a conductive wire to which a high voltage is applied is placed inside the slender cavity of the capillary.

17. In a laser spray apparatus for ionizing a liquid sample by irradiating, with a laser beam, the end of a capillary into which the sample has been introduced, an ionization apparatus characterized in that at least the end of the capillary is formed of a substance that does not readily absorb the laser beam used, and a corona-discharge electrode is provided in the vicinity of the end of the capillary.

18. An ionization apparatus according to claim 16, wherein the conductive wire is inside the capillary and extends to a point near the end of the capillary.

19. An ionization apparatus according to claim 16, wherein the end of the conductive wire is caused to project slightly beyond the diamond tip at the end of the capillary.

20. An ionization apparatus wherein an ionization space communicating with a mass analyzer through an ion introduction port is formed by a housing on the outer side of the ion introduction port of the mass analyzer;

at least the end of the capillary into which a liquid sample is introduced is placed inside the ionization space;

a laser device for irradiating the end of the capillary is placed outside the ionization space; and at least the end of the capillary is formed of any of diamond, silicon or germanium which is a substance that does not readily absorb the laser beam used.

* * * * *